US005660378A

United States Patent [19]

Schall

[11] Patent Number: 5,660,378

[45] Date of Patent: Aug. 26, 1997

[54] FENCE ASSEMBLY

[75] Inventor: Frederick R. Schall, Mt. Laurel, N.J.

[73] Assignee: Delair Group LLC, Delair, N.J.

[21] Appl. No.: 671,538

[22] Filed: Jun. 27, 1996

[51] Int. Cl.[6] ..... E04H 17/00

[52] U.S. Cl. ..... 256/65; 256/59; 256/22

[58] Field of Search ..... 256/22, 21, 59, 256/65

[56] References Cited

U.S. PATENT DOCUMENTS

| | | | |
|---|---|---|---|
| 2,145,172 | 1/1939 | Gustafson | 256/22 |
| 2,218,953 | 10/1940 | Gustafson | 256/22 |
| 3,815,876 | 6/1974 | Saez | 256/22 |
| 5,002,260 | 3/1991 | Lustvee | 256/22 |
| 5,120,025 | 6/1992 | D'Avanzo | 256/22 |
| 5,443,244 | 8/1995 | Gibbs | 256/22 |

FOREIGN PATENT DOCUMENTS

| | | | |
|---|---|---|---|
| 66844 | 10/1914 | Germany | 256/22 |
| 6504963 | 4/1964 | Netherlands | 256/22 |

*Primary Examiner*—Anthony Knight
*Attorney, Agent, or Firm*—Jay M. Cantor

[57] ABSTRACT

A method of making an assemblable fence and the fence which includes a plurality of spaced apart pickets, each picket having an aperture therein facing in the same direction, an insert having an edge with a single or plurality of spaced apart fingers disposed along the edge, the spacing between the fingers being the same as the spacing between the center portions of the pickets and a substantially U-shaped rail having an intermediate portion and a pair of spaced apart portions extending from the intermediate portion. The insert is placed between the rail and the pickets so that the fingers are aligned with the apertures and above the apertures in the pickets. The rail and fingers are then moved toward the apertures until the fingers enter and are locked in the apertures. In one embodiment, the step of moving the rail and the fingers further includes continuing to move the rail and the fingers in the same direction after entry of the fingers into the apertures to provide the locking. This is accomplished by providing a locking device having an ω-shaped portion with a top semi-circular portion and a bottom semi-circular portion, the step of locking including rotating the insert from the top semi-circular portion to the bottom semi-circular portion to provide locking in conjunction with the aperture. In the second embodiment the locking device includes a flange extending toward the pickets and the step of locking the insert between the flange and the intermediate portion of the U-shaped rail.

12 Claims, 2 Drawing Sheets

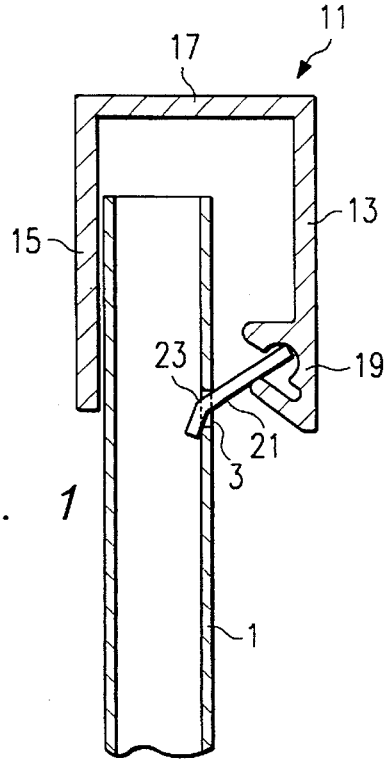
FIG. 1
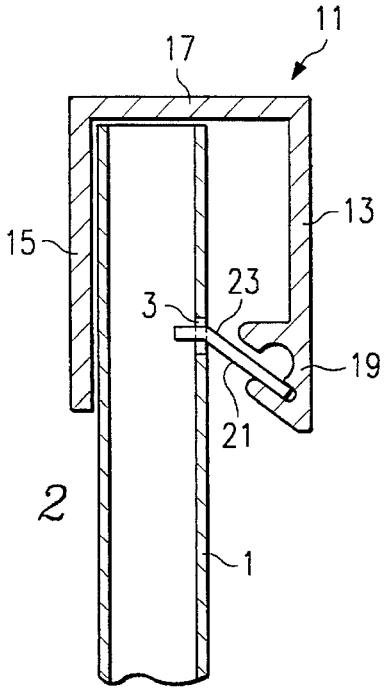
FIG. 2
FIG. 3
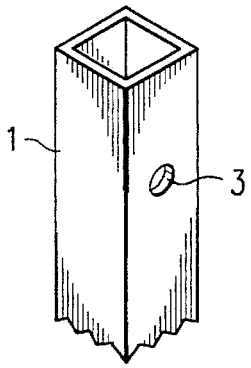
FIG. 4
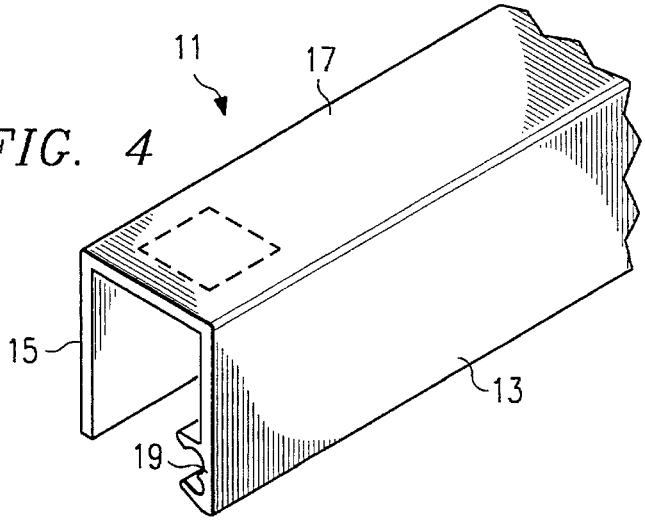
FIG. 5
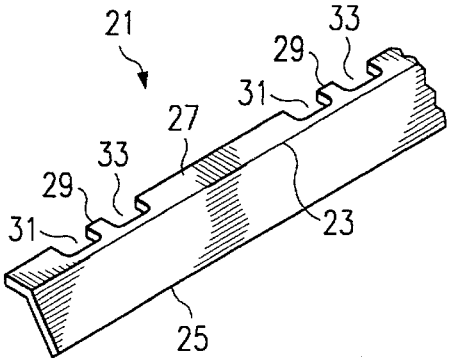

FENCE ASSEMBLY

BACKGROUND OF THE INVENTION

1. Field of the Invention

This invention relates to a fence assembly and, more specifically, to a metal or plastic fence which is easily assembled on-site.

2. Brief Description of the Prior Art

Unassembled fences, both of the wood, plastic and metallic type, which can be erected on-site, are well known in the industry. A problem with the prior art unassembled or partially assembled fences is that assembly has been relative time consuming, particularly because the connection of the fence rails to the pickets have required the use of fasteners, particularly screws, nuts and bolts and the like with at least one such fastener generally being required at the intersection of each picket and each rail. It is therefore apparent that, for example, even in the case of a small ten foot length of fence having as little as two rails with widely spaced apart pickets spaced as much as, for example, one foot apart, there will be required insertion of at least twenty-two fasteners. Especially in the case of metal fencing where the screw or nut and bolt receiving apertures must be pre-formed in both the rail and the picket, it is necessary to align the apertures in the rails with the apertures in the pickets and then proceed to secure a fastener through both apertures at the intersection of each rail and picket. It is readily apparent that such an operation is extremely time consuming even for a small fence with widely spaced pickets. With fences of greater length and/or more narrow spacing between pickets, as is generally the case, the problem is magnified. It is therefore apparent that a fence which can be less labor-intensively assembled is highly desirable.

SUMMARY OF THE INVENTION

In accordance with the present invention, there is provided an unassembled metallic or plastic fence, preferably partially or entirely fabricated with extruded aluminum or plastic parts which can be assembled on-site with a minimum of labor and without the requirements of screws, nut and bolts or the like.

Briefly, the above is accomplished by providing a plurality of pickets which are spaced apart from each other a predetermined distance. Each of the pickets is preferably rectangular in shape, though other shapes can be used, and preferably has a hollow interior, though a solid interior can also be provided, especially if the picket is formed of wood. The picket also contains a number of vertically aligned holes disposed along a line on the surface of each picket parallel to the major axis of the picket. The holes in each picket are preferably vertically spaced apart the same distance for retention of the finger of an insert therein as will be explained. The pickets are preferably of extruded aluminum but can also be formed from other materials such as, for example, steel, wood, plastic or the like.

The top rail is U-shaped, having a pair of parallel side sections and an intermediate top section. The top rail is also preferably fabricated of extruded aluminum and fits over the top of each of the pickets. Alternatively or in addition, the top rail can be altered to provide a rail secured to pickets a distance below the top of the picket which is greater than the lengths of the side sections. This is accomplished by providing apertures therein in the top section to permit the pickets to pass through the apertures so that the rail can be secured to the picket intermediate the top of the picket and the ground and be used as an intermediate rail with or without a similar top rail without the aperture in the intermediate top section. The front end of each rail has an ω-shaped portion at its lowermost edge region for receiving an insert and permitting rotation of the insert therein as will be explained.

The insert is preferably an aluminum extrusion or stamped metal or plastic section having fingers on one edge for entry into the aligned holes in the pickets with the opposing edge disposable in the ω-shaped portion of the rail. The insert preferably has a slight bend along a line parallel to said opposing edges thereof to assist in the angle of entry of the finger into the aligned hole.

By placing the insert into the ω-shaped portion of the rail with the side containing the fingers in a downward position and then moving the rail downward over the picket along with the insert, the fingers of the insert will ultimately engage the holes in the pickets with the insert then being rotated about 90° within the ω-shaped portion from the top semi-circle portion of the ω to the bottom semi-circle portion of the ω to lock the rail in place. This negates the requirement of screws, nuts and bolts and the like. The same action takes place in the case of a top rail except that the top rail is locked in place before or when the intermediate section of the "U" contacts the top of the picket.

As an alternate embodiment, the U-shaped rail is provided with an inwardly extending flange at its lowermost edges in place of the ω-shaped portion and the insert is altered to include a finger which engages the hole in each picket, which has a dimension to fit snugly between the flange and the intermediate section of the rail and which is shaped to rest on the flange while contacting the picket and the side of the rail. In this way, the finger of the insert is engaged into the hole in the picket and, while the rail is moved downwardly along the sides of the pickets, the rail engages over the insert. The rail continues to be moved downwardly until the flange on the rail engages over the insert completely. At this point, the rail is locked in place to the pickets.

BRIEF DESCRIPTION OF THE DRAWINGS

FIG. 1 is a side view in cross-section of a fence in accordance with a first embodiment of the present invention during assembly;

FIG. 2 is a view as in FIG. 1 after completion of assembly of the first embodiment;

FIG. 3 is a perspective view of a portion of a picket in accordance with the present invention;

FIG. 4 is a perspective view of a top rail in accordance with the first embodiment of the present invention;

FIG. 5 is a perspective view of an insert in accordance with the first embodiment of the present invention;

DESCRIPTION OF THE PREFERRED EMBODIMENTS

Figure 6:
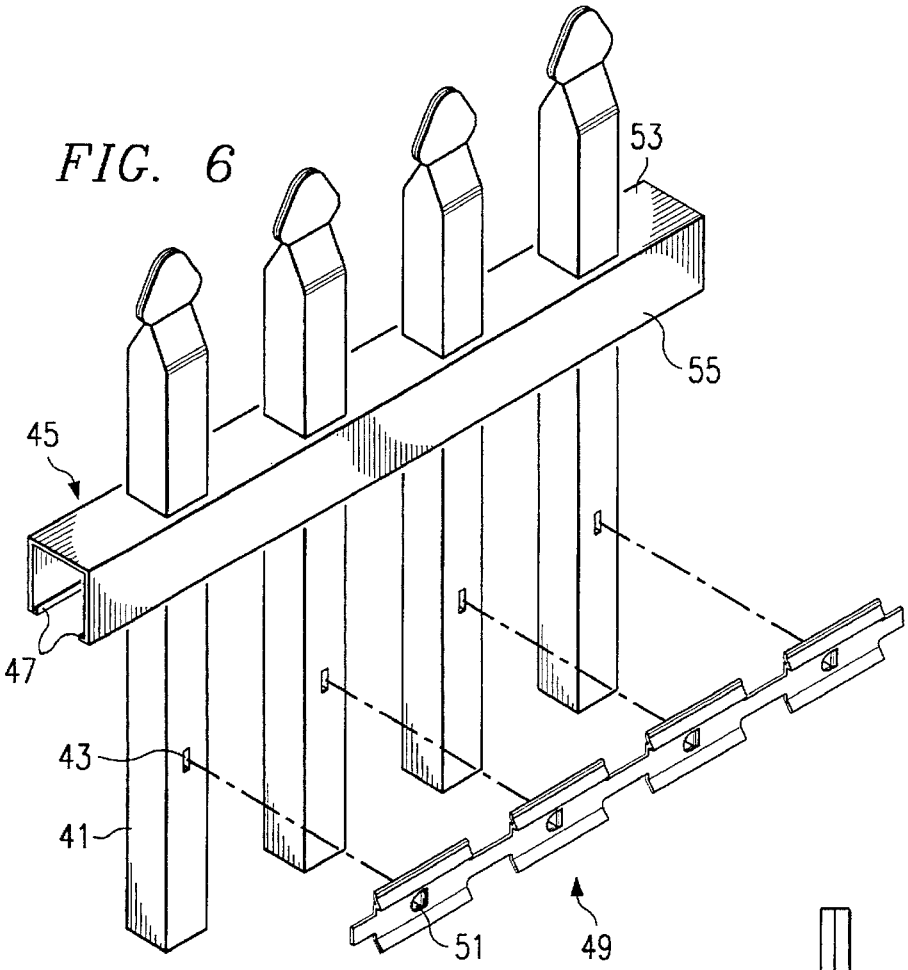
FIG. 6 is a partially exploded view of a fence in accordance with a second embodiment of the present invention.

Referring first to FIG. 1, there is shown a single picket 1 (FIG. 3), it being understood that a fence will include a plurality of such pickets in spaced apart relation. A U-shaped fence rail 11 (FIG. 4) having parallel side portions 13 and 15 and an intermediate portion 17 is designed to fit over a plurality of pickets 1. The bottom edge of the side portion 13 includes an ω-shaped portion 19 for receiving therein an insert 21 (FIG. 5).

With reference to FIG. 3, the pickets 1 include one or more holes 3 along a line in a surface thereof parallel to the major axis of the picket, the holes being disposed at the heights of the rails to be secured to the pickets. The pickets 1 are preferably rectangular and of extruded aluminum or plastic with a hollow center section.

With reference to FIG. 4, there is shown the fence top rail 11. The top rail 11 can be converted into a rail for use below the top region of the pickets by cutting holes (one shown in phantom in FIG. 4) in the intermediate portion 17 thereof which is of adequate size and location for pickets 1 to extend therethrough. The ω-shaped portion 19 is designed to permit the insert 21 to be retained between the rail 11 and the picket 1 with the edge of the insert remote from the rail and against the picket extending in a direction to include a downward component as shown in FIG. 1. When sufficient upward force is applied to the picket 1, the insert will rotate within the ω-shaped portion 19 to include an upward component as shown in FIG. 2.

With reference to FIG. 5, there is shown the insert 21 which is preferably formed from extruded aluminum or plastic or stamped and shaped metal such as steel or aluminum. The insert 21 is generally a rectangle having a much greater length than height and width sufficient to provide the required strength to the insert to withstand bending under the forces to be applied thereto during and after fence assembly. The insert 21 has a small bend 23 along a line parallel to the edges along the length of the insert. One of the major edges 25 of the insert is relatively straight whereas the other major edge 27 includes fingers 29 which can extend outwardly from the edge 27 or can be provided by removing a sufficient portion of the metal during insert formation to provide escalloped regions 31 and 33 on opposite sides of the fingers 29 of sufficient width such that the length of the escalloped regions 31, 33 and finger 29 are sufficient to allow the finger 29 to enter the hole 3 with the escalloped regions wrapping around the picket 1.

In operation, the top rail 11, insert 21 and picket 1 are arranged as shown in FIG. 1 with the fingers 29 of the insert above and aligned with the topmost hole 3 in the picket 1. The top rail 11 is then lowered until the fingers 29 engage the holes 3 in the pickets whereupon the insert 21 is rotated in the ω-shaped portion 19 to the position shown in FIG. 2. In this position, either the intermediate portion 17 of the top rail will abut the top of the picket 1 to end downward travel (as shown) or the insert 21 will abut the top portion of the ω-shaped portion 19 to end downward travel of the rail 11. In the case where the rail 11 is not the top rail and has an aperture therein as shown in phantom in FIG. 4, the operation is the same except that downward travel of the rail will end when the insert 21 abuts the top portion of the ω-shaped portion 19.

Figure 7:
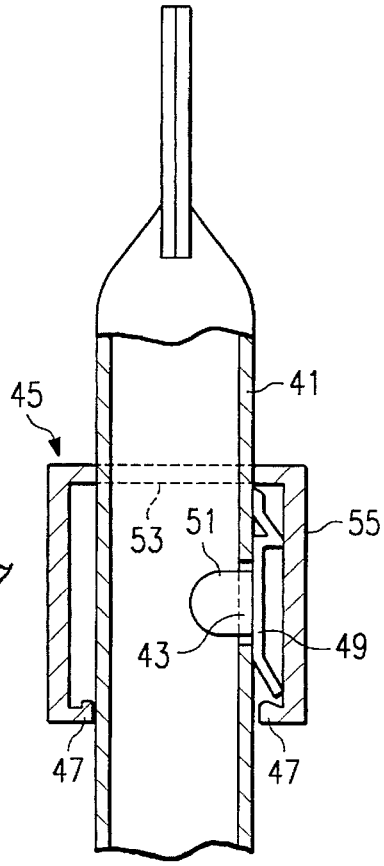
FIG. 7 is a cross-sectional view of the second embodiment of the present invention in assembled condition.

Referring now to FIGS. 6 and 7, there is shown a second embodiment of the invention wherein the rail and insert have been altered as will be described. The picket can be the same as in the first embodiment and the rail, though shown as an intermediate rail with the portion shown in phantom in FIG. 4 removed, can also be used as a top rail as discussed above with reference to the first embodiment. The picket 41 has one or more holes 43 therein in the same manner as discussed above with regard to picket 1 and holes 3. The fence rail 45 is U-shaped and has an inwardly extending flange 47 at one or both of its lowermost edges in place of the ω-shaped portion 19 of the first embodiment, only the flange along the side of the picket 41 having the holes being required. The insert 21 of the first embodiment is altered to provide an insert 49 which includes a finger 51 which engages the hole 43 in each picket 41. The insert 49 has dimensions to fit snugly between the flange 47 and the intermediate section 53 of the rail 45 and which is shaped to rest on the flange while contacting the picket 41 and the side 55 of the rail. The insert 49 is positioned on the pickets 41 so that the fingers 51 are inserted into holes 43 in the pickets. The rail 45 is moved downwardly over the inserts 49, this engaging the insert 49 within and adjacent to flange 47 of rail 45. The rail 45 continues to be moved downwardly until flange 47 snaps over the lower edge of insert 49. At this point, the rail 45 is locked in place to the pickets 41.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. An assembled fence which comprises:

(a) a plurality of pickets, each of said pickets having an aperture therein;

(b) an insert having an edge with at least one finger disposed along said edge, each said at least one finger being disposed in a said aperture; and (c) a substantially U-shaped rail having an intermediate portion and a pair spaced apart portions extending from said intermediate portion disposed along and parallel to opposing surfaces of each of said pickets and locking said insert in said aperture in conjunction with said pickets;

(d) one of said spaced apart portions including locking means including an ω-shaped portion having a top semi-circular portion and a bottom semi-circular portion, said insert being rotatable from said top semi-circular portion to said bottom semi-circular portion to provide locking in conjunction with said aperture.

2. The fence of claim 1 wherein said insert includes a pair of parallel opposed edges and an intermediate portion, said intermediate portion having a bend therein parallel to said opposed edges.

3. The fence of claim 1 wherein said one of said opposed edges includes a plurality of spaced apart fingers, the spacing between said fingers being the same as the spacing between the center portions of said pickets.

4. The fence of claim 1 wherein one of said opposed edges includes a single finger.

5. A method of making an assemblable fence comprising the steps of:

(a) providing a plurality of spaced apart pickets, each of said pickets having an aperture therein facing in the same direction;

(b) providing an insert having an edge with at least one finger disposed along said edge;

(c) providing a substantially U-shaped rail having an intermediate portion and a pair spaced apart portions extending from said intermediate portion;

(d) one of said spaced apart portions including locking means including an ω-shaped portion having a top semi-circular portion and a bottom semi-circular portion, and rotating said insert from said top semi-circular portion to said bottom semi-circular portion to provide locking in conjunction with said rail;

(e) placing said insert between said rail and said pickets so that said at least one finger is aligned with a said aperture and above said aperture in said pickets; and (f) moving said rail and said at least one finger toward said apertures until said at least one finger enters and is locked in a said aperture.

6. The method of claim 5 whereins aid locking means includes a flange extending toward said pickets, further including the step of locking said insert between said flange and said intermediate portion of said U-shaped rail.

7. An assembled fence which comprises:

(a) a plurality of pickets, each of said pickets having a major axis and an aperture therein;

(b) a separate insert having at least one finger extending therefrom, each said at least one finger being disposed in a different said aperture, said insert having a pair of opposing edges disposed normal to said major axis, one of said edges extending inwardly toward said at least one picket and the other of said edges extending outwardly away from said at least one picket; and (c) a substantially U-shaped rail, said U comprising an intermediate portion and a pair of spaced apart portions extending from said intermediate portion disposed along and parallel to opposing surfaces of each of said pickets, said rail including locking means for locking said insert in said aperture in conjunction with said pickets.

8. The fence of claim 7 wherein said locking means includes one of said pair of spaced apart portions, said one of said pair of spaced apart portions including a flange extending toward said picket from a terminal portion thereof, said edges of said insert extending outwardly and resting on said flange.

9. The fence of claim 8 wherein said insert is dimensioned to fit snugly between said flange and said intermediate portion.

10. The fence of claim 7 wherein said insert is dimensioned to fit snugly between said flange and said intermediate portion.

11. A method of making an assemblable fence comprising the steps of:

(a) providing a plurality of pickets, each of said pickets having a major axis and an aperture therein;

(b) providing a separate insert having at least one finger extending therefrom, said insert having a pair of opposing edges disposed normal to said major axis, one of said edges extending inwardly toward said at least one picket and the other of said edges extending outwardly away from said at least one picket;

(c) providing a substantially U-shaped rail, said U comprising an intermediate portion and a pair of parallel spaced apart portions extending from said intermediate portion;

(d) disposing each said at least one finger in a different said aperture; and (e) sliding said rail over said insert so that said rail travels first over said one of said edges extending inwardly toward said at least one picket until said flange extends below said other of said edges extending outwardly away from said at least one picket and said other of said edges extending outwardly away from said at least one picket rests on said flange.

12. The method of claim 11 wherein said insert is dimensioned to fit snugly between said flange and said intermediate portion.

* * * * *